United States Patent [19]

Tesoro

[11] 4,111,652

[45] Sep. 5, 1978

[54] SYNERGISTIC FLAME RETARDANT MIXTURES AND PRODUCTS

[75] Inventor: Giuliana C. Tesoro, Dobbs Ferry, N.Y.

[73] Assignee: Ethyl Corporation, Richmond, Va.

[21] Appl. No.: 782,430

[22] Filed: Mar. 29, 1977

[51] Int. Cl.[2] ..... D06M 1/22; D06M 13/20; D06M 13/26; C09K 3/28

[52] U.S. Cl. ..... 8/116 P; 252/8.8; 252/8.1; 427/390 D; 106/15 FP

[58] Field of Search ..... 8/116 P; 427/390 D; 106/15 FP; 252/8.8 AN, 8.1

[56] References Cited

PUBLICATIONS

Tesoro, G. C. et al., Textile Research Journal, Feb. 1976, pp. 152–153.

Morris, C. E. et al., Textile Research Journal, vol. 43, No. 6, 1973, pp. 336–341.

*Primary Examiner*—Joseph L. Schofer

*Assistant Examiner*—Maria S. Tungol

*Attorney, Agent, or Firm*—Donald L. Johnson; John F. Sieberth; Robert A. Linn

[57] ABSTRACT

Mixtures of chloromethyl phosphonic diamide (CMPDA) and methyl phosphonic diamide (MPDA) have synergistic flame retardant efficiency on cellulose-containing textile substrates.

8 Claims, No Drawings

SYNERGISTIC FLAME RETARDANT MIXTURES AND PRODUCTS

BACKGROUND OF THE INVENTION

Phosphorus and nitrogen are synergistic in flame retardant finishes for cellulosic fibers; Tesoro et al, *Textile Res. J.* 38, 245–255 (1968). The use of N-hydroxymethyl dimethylphosphonopropionamide in conjunction with triazine is an example of a commerically successful finish based on this concept; Aenish Anslin et al, *Textile Res. J.* 39, 375–381 (1968). Thermochemical studies have indicated that if phosphorous and nitrogen atoms are directly linked, their flame retardant effectiveness might be enhanced; Barker, *Textilveredlung* 8, 180–186 (1974).

Among compounds in which P-N linkages are present, some have been claimed as flame retardant finishes; British 1, 126, 259. The performance of chloromethylphosphonic diamide as a flame retardant for cotton has been described; Morris et al, *Textile Res. J.* 43, 336–341 (1973), but the comparatively low degree of fixation and durability reported made this compound appear rather unattractive.

Excellent results have been reported in the treatment of cotton fabrics with bis-aziridinyl chloromethylphosphine oxide (BACPO); *Textile Chemists and Colorists* 6, 148–153 (1974). In the heat cure, and in subsequent launderings, the nitrogen content of BACPO is almost completely preserved. Its fixation to cotton can be attributed to the formation of an ether linkage with cellulose by opening of the aziridine ring and/or the ring-opening aziridine polymerization reaction.

Use of methylphosphonic diamide as a catalyst to improve the thermal carbonization of cellulosic fibrous substrates has been claimed, Moore et al, U.S. Pat. No. 3,527,564. Flame retardant use of MPDA is disclosed by Tesoro et al in the Feb. 1976, issue of *Textile Research Journal.*

SUMMARY OF THE INVENTION

As indicated above, this invention pertains to flame retardation of cellulosic textiles. In a preferred embodiment, the invention relates to unexpected synergistic effects in the flame retardant efficiency of mixtures of methyl phosphonic diamide (MPDA) and chloromethyl phosphonic diamide (CMPDA) on cellulose-containing textile substrates.

As discussed above, it is known to treat cellulosecontaining fabrics with MPDA or with CMPDA to decrease their flammability. It is also known that the decrease in flammability, as measured for example by the oxygen index method, is generally proportional to the amount of phosphorous which is present in the cellulosic substrate. In other words, the higher the phosphorus content in the treated fabric, the higher the oxygen index (or the lower the flammability) of the particular treated material.

In the process of the present invention, the cellulosecontaining fabric is modified with mixtures of MPDA and CMPDA and these mixtures are found to be more effective than either reagent used alone. At the same phosphorus content, a sample treated with the MPDA/CMPDA mixture (for example, equimolar mixture) has a significantly higher oxygen index value than a comparable sample of the same fabric treated with either MPDA alone or CMPDA alone.

Thus, in preferred embodiments, this invention pertains to (a) Synergistic flame retardant mixtures of methyl phosphonic diamide and chlormethyl phosphonic diamide; and (b) A mixture of substantially equimolar portions of methyl phosphonic diamide and chloromethyl phosphonic diamide.

Such mixtures need not be pure, they may contain other materials such as those which improve a flame retardant process of this invention or the results therefrom. Thus, there can be added or present in such mixtures for example, agent(s) which preserve whiteness of white fabrics, or substance(s) which aid or enhance the flame retardant properties of the mixtures, or agent(s) which increase the efficiency of insolubilization of the mixtures, or more components thereof, onto the treated substrate(s). Another preferred embodiment of this invention is (c) A process for rendering a cellulosecontaining textile flame retardant, said process comprising (i) contacting said textile with a liquid-containing substance comprising a mixture of flame retardants such as described above, (ii) subsequently drying the treated textile, and (iii) curing the dried textile, thereby bonding flame retardant reaction products to said textile. This process can be conducted with a substantially equimolar mixture of CMPDA and MPDA.

This invention also pertains to (d) A flame resistant cellulosiccontaining product rendered flame retardant by such a process, for example a process employing a substantially equimolar mixture of CMPDA and MPDA.

DESCRIPTION OF PREFERRED EMBODIMENTS

Chloromethyl phosphonic diamide can be prepared by the method of British Pat. No. 1,126,259. Methyl phosphonic diamide can be made by the procedure of Ratz, R. J. Am. Chem. Soc. 77, 1470 (1959). Such processes can be depicted by the following equation where R is methyl and/or chloromethyl:

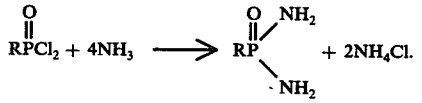

The British patent and journal article describe means for separating $NH_4Cl$ from the phosphonyl product. When such separation(s) are desired for purposes of this invention, the literature method(s) can be carried out.

For this invention, mixtures of CMPDA and MPDA are employed. The relative amounts of such mixtures are such that the flame retardant properties conferred upon a substrate treated therewith are synergistic as exemplified below. The mixtures may be prepared as reaction products from mixtures of intermediates, for example

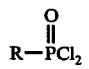

where R is methyl and chloromethyl, or by mixing previously prepared products.

Synergistic results are achieved with equimolar amounts of CMPDA and MPDA. It is not necessary that the mixtures be exactly equimolar, substantially equimolar mixtures can be used. For the purposes of this invention, "substantially equimolar" means a mixture of from 0.9 to 1.1 moles of one of CMPDA or MPDA per each mole of the other.

It is to be understood, however, that it is unnecessary to 'limit' the relative amount of either additive in the mixture. This is so because both CMPDA and MPDA have flame retardant properties. However, to achieve best results, the overall flame retardant effect conferred by the mixture employed should comprise a noticeable effect due to the synergy. In other words, for the benefits of this invention to be realized, one employs a mixture of CMPDA and MPDA that confers a greater amount of flame retardancy than the same amount of phosphorus as one or the other agent used alone. Thus, the determine whether the mixture employed confers such a synergistic beneficial effect, a skilled practitioner (a) measures the flame retardancy conferred by the desired mixture using a suitable technique such as the oxygen index (O.I), (b) comparatively measures the flame retardancy conferred for the same amount of phosphorus as CMPDA, and the flame retardancy conferred for the same amount of phosphorus as MPDA (using the same measuring technique such as O.I. and keeping other experimental conditions substantially constant), and (c) compares the results to see if the mixture confers a greater amount of flame retardancy. Such a comparison is readily conducted by a skilled practitioner, and as can be seen, requires a minimum of experimentation. By such technique it can be determined whether the mixture employed (and its use) falls within the scope of this invention.

In the process of this invention, a suitable mixture of CMPDA and MPDA is applied to the substrate to be treated. This involves an insolubilization of flame retardant moieties onto the substrate. The following description is directed to treatment of cellulosic textiles such as cotton, cotton/polyester blends, linen, rayon and the like.

The processes of this invention are primarily useful for treatment of 100 percent cotton fabrics. Thus, they are useful for fabrics which are blends of cotton with polyester or other synthetic fibers in which the cotton content may be from 80 percent upward. Likewise, the processes are useful for fabrics made from regenerated cellulose fibers such as viscose rayon, either entirely or in blends with other fabrics. Fabrics made from blends or mixtures of cotton fibers and regenerated cellulose fibers that are commonly used for draperies and upholstery fabrics can be advantageously treated according to the processes described in the present application. In a test the synergistic effect was not noted on a 50/50 cotton/polyester fabric. It is not known whether this was due to the particular fabric employed in the test.

The fabric is padded or otherwise impregnated with suspensions or solutions of the products, dried, cured to insolubilize the flame retardant, and washed to remove soluble residues. The concentration of the solution or suspension applied depends on the particular blend used on the fabric being treated, on the amount of liquid absorbed by the fabric in padding, and on the required level of flame resistance. Concentrations of products ranging from about 10 percent to 20 percent are satisfactory for most fabrics.

The weight gain due to treatment may be from 1 to 30 weight percent, more preferably from about 5 to about 15 weight percent. The weight gain should be sufficient to give at least about 1.5 to 4 weight percent phosphorus on the fabric or other cellulosic material to be treated. The nature of the solvent is not critical. Most preferably, water is employed. Appropriate organic solvents can also be used.

Drying conditions are not critical. Heat is applied to remove moisture. Temperatures of 70°-120° C. for 0.5 to 5 minutes and curing temperatures of from 280° to 380° F. are generally required. The yield obtained in the reaction with cellulose (insolubilization efficiency) can be calculated from the amount of phosphorus retained in the fabric after the process wash. The yield in some instances approaches 100 percent, even though optimum treatment conditions vary from substrate to substrate and may be determined by routine experimentation.

In a preferred embodiment of the present invention, the solution or suspension of the flame retardant compounds contains an additive which further improves the results obtained in the process with respect to appearance (preserving whiteness in the case of white fabrics), or efficiency of insolubilization of the added phosphorus, or performance properties of the treated fabrics. The mechanism by which the additives produce such extraordinary improvements is not fully understood and several classes of additives have varying degrees of effectiveness. The preferred additives depends on the specific substrate and on other factors, but such additives may be selected from the following:

(A) Inorganic bases wihich neutralize the ammonium chloride which may be present in the crude reagent, i.e. reagent prepared according to the equation given above; the amount of base used should be controlled to obtain a pH of about 6 to 10 in the treating solution; a pH of 6–7 is preferred.

(B) Formaldehyde, used in amounts of about 0.2 percent to 3.0 percent based on the weight of treating solution;

(C) Polyfunctional N-methylol compounds such as dimethylol ethylene urea,

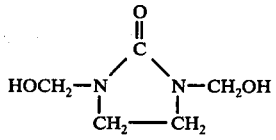

N,N-dimethylol methyl carbamate,

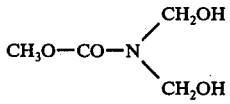

and the like, used in amounts of about 0.5 percent to 5 percent, based on the weight of treating solution;

(D) N-methylol dialkyl-phosphonopropionamides such as

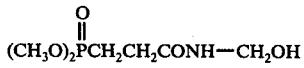

and the like, used in amounts of about 0.5 percent to 5 percent, based on the weight of solution.

In some instances it may not be possible to fix a larger amount of reactant than that corresponding to about 4 percent P on the weight of cotton. Combination with reactive melamine compounds may be used if higher levels of flame resitance are required.

(E) tremethylolmelamine used in amounts of 0.5 to 5 percent based on the weight of solution.

A particularly important feature of the present invention is that the compounds CMPDA and MPDA introduce covalently bound phosphorus into the cellulose molecule, providing that appropriate conditions of curing for the specific reagent are used.

High curing temperatures of from about 325° to 380° F. and short curing times (e.g. 0.5 to 5 minutes) are more effective than longer times at lower temperature. However, heating times of from several seconds to as long as several minutes, say 7 or more, can be used.

In certain instances the reactivity of the compounds may be enhanced, when the treating solution contains certain additional ingredients which are inert with regard to flame retardant effect. Such additional ingredients are within classes of chemical compounds (given above) where effects might range from catalysis of cellulose reaction (as in the case of ammonium salts, amine salts, or other acid-forming compounds) to buffering and neutralization of acidic groups (as in the case inorganic base) to competitive reactions with the substrate (as in the case of formaldehyde and N-methylol compounds).

The course of the insolubilization reaction which bonds fire retardant moieties to the treated substrate is caused by curing is not fully understood. It is postulated that cellulose derivatives may be formed, including for example, crosslinked cellulose phosphonates:

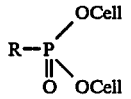

wherein Cell illustrates a cellulose moiety.

The conditions described are consistent with application conditions recommended for other finihses (e.g. durable press) on cellulosic fabrics, and combinations of the novel flame retardants with other functional finishes are within the scope of the present invention.

In some instances it may not be possible to fix a larger amount of reactant than that corresponding to about 4 percent P on the weight of cotton. Combination with reactive melamine compounds may be used if higher levels of flame resistance are required.

EXAMPLE 1

To illustrate this invention, 100 percent cotton print cloth was modified by reaction with varying concentration of flame retardants and yielded the following results.

| Percent P in modified fabric | 1.5 | 2.0 | 2.5 |
|---|---|---|---|
| OI of samples modified with MPDA | 24.1 | 25.5 | 29 |
| with CMPDA | 24.0 | 25.3 | 28.8 |
| with equimolar mixture of MPDA CMPDA | 27.2 | 31.1 | 36.2 |

The unmodified had an OI of 17.8. As can be seen, there is a very substantial increase in OI conferred by the mixture of CMPDA and MPDA, particularly at the higher concentrations of phosphorus.

EXAMPLE 2

An aqueous mixture of 9.4 weight percent of MPDA and 12.8 percent CMPDA with 3 percent urea in the bath was padded on Style 400M cotton print cloth at 70 psi, three times, dried at 82° C. for 10 minutes and cured at 191° C. for 80 seconds. Soluble materials were washed off and the dried treated fabric tested to yield the following results.

Table 1

Replicate treatments of cotton printcloth with 9.4 percent MPDA and 12.8 percent CMPDA, and 3 percent urea in the bath.

| Experiment | Percent Wet Pick-up | Calculated on Wt. (%) Wt. Gain | Eff'y | LOI (% $O_2$) | Anal. P | (%) Cl |
|---|---|---|---|---|---|---|
| 2-1a | 90 | 10.6 | 55 | 30.3 | — | — |
| b | 66 | 11.7 | 83 | 35.5 | 3.48 | 1.24 |
| c | 83 | 12.6 | 71 | 35.8 | — | — |
| d | 87 | 12.7 | 68 | 37.2 | — | — |
| 4-1a | 87 | 12.3 | 64 | 34.3 | 2.8 | 0.96 |
| b | 91 | 14.3 | 70 | — | 2.3 | 0.86 |

With 9.4 percent MPDA and 12.8 percent CMPDA at 66 percent wet pickup (sample 1b), the phosphorus applied should be 2.0 percent by each. Analysis showed 3.48 percent P and 1.24 percent Cl on the treated fabric (after the process wash) for an apparent 88 percent efficiency of P fixation. If all of the chlorine on CMPDA remained fixed, as it did in previous experiments with pure CMPDA alone, the contribution of P from CMPDA would be almost 1.1 percent P; and therefore 2.4 percent P would be provided by the MPDA. However, the 2.4 percent P would be more than the applied P from MPDA at 66 percent wet pickup. Furthermore, the wet pickup of 66 percent appears to be in error because the other five (5) replicate samples ranged from 83 percent to 91 percent wet pickup. It would appear that MPDA is more reactive than CMPDA in the application of the mixture.

After 10 washes for sample 4.-1a, the phosphorus analysis was 2.4 and the chlorine analysis 0.77% by weight. For sample 4-1b, the P and Cl analysis in wt% after 10 washes were: 2.3 and 0.75, respectively.

In a similar fashion, cotton printcloth was treated with an aqueous bath of 6.2 percent MPDA and 8.6 percent CMPDA and 3 percent urea. Experimental results were as follows.

Table 2

Replicate treatments of cotton printcloth, with 6.2 percent MPDA and 8.6 percent CMPDA, and 3 percent urea in the bath.

| Experiment No. | Percent Wet Pick-up | Calculated on Wt. (%) Wt. Gain | Efficiency | LOI (% $0_2$) | Anal. P | (%) Cl |
|---|---|---|---|---|---|---|
| 2-2a | 77 | 11.7 | 100 | 31.8 | — | — |
| b | 103 | 9.1 | 60 | 32.1 | 2.67 | 0.99 |
| c | 86 | 10.1 | 79 | 34.1 | — | — |
| d | 85 | 11.3 | 90 | 34.4 | — | — |
| 4-2a | 87 | 11.1 | 86 | 34.7 | 2.3 | 0.89 |
| b | 89 | 10.4 | 81 | — | 2.2 | 0.86 |

With 6.2 percent MPDA and 8.6 percent CMPDA padded at 103 percent wet pickup, the P applied should be 2.0 percent from each. Analysis showed 2.7 percent P and 0.99 percent Cl. Therefore, the efficiency was 68 percent for P fixation, and 0.8 percent P was contributed by the CMPDA, leaving 1.9 percent P contributed by the MPDA—again, the MPDA is shown to be more reactive than CMPDA (if the assumption that no chlorine is lost is correct).

For sample 4-2*a*, after 10 washes P and Cl analyses in wt. % were 2.3 and 0.76, respectively. For sample 4-2*b*, the P and Cl analyses after 10 washes were 2.1 and 0.74 weight %, respectively.

Table 3

Replicate treatments of cotton printcloth, with 4.7 percent MPDA, and 6.4 percent CMPDA, and 3 percent urea in the bath.

| Experiment No. | Percent Wet Pick-up | Calculated on Wt. Wt. Gain | Efficiency | LOI ($O_2$) | P (Anal.) | Cl |
|---|---|---|---|---|---|---|
| 4-3a | 84 | 7.4 | 80 | 29.6 | 1.8 | 0.74 |
| b | 85 | 7.5 | 80 | 29.3 | 1.7 | 0.74 |
| c | 85 | 6.3 | 67 | 28.8 | 1.6 | 0.68 |
| d | 88 | 8.2 | 84 | 30.6 | 2.0 | 0.63 |

With 4.7 percent MPDA and 6.4 percent CMPDA padded at 85 percent wet pickup, the calculated efficiency is about the same as in the Experiments of Table 2. The Limiting Oxygen Index is 30 (vs. 33) for the Table 2 samples because of the lower amount of reagent applied.

The fabrics employed in Example 2 were Testfabrics Style 400M, a mercerized white cotton 80 × 80 printcloth. A limiting oxygen index method which is suitable is that described in *Textile Res. J.* 40, 204 (1970). The children's sleepwear test DOC-FF3-71 is described in Federal Register Vol. 36 No. 146 Thursday, July 29, 1971.

EXAMPLE 3

The effect of laundering was studied to learn the durability of the finish. Results were as follows.

Table 4

Effect of Laundering on Phosphorus and Chlorine Content of 80 ×80 Printcloth treated with Equimolar Mixtures of MPDA and CMPDA in Pad Bath (See Example 2).

| Expt. No. | Cycles Laund. | Analyses % P | % Cl | % P Calc'd[a] CMPDA | MPDA | P Ratio by MPDA/CMPDA |
|---|---|---|---|---|---|---|
| A-1 With 9.4 % MPDA, 12.8 %CMPDA, and 3 % Urea in the pad bath | | | | | | |
| 2-lb | 0 | 3.5 | 1.24 | 1.08 | 2.4 | 2.2 |
| 4-1a | 0 | 2.8 | 0.96 | 0.84 | 2.0 | 2.4 |
| | 6 | 2.5 | 0.75 | 0.65 | 1.8 | 2.8 |
| | 10 | 2.4 | 0.77 | 0.67 | 1.7 | 2.5 |
| 4-lb | 0 | 2.3 | 0.86 | 0.75 | 1.5 | 2.0 |
| | 10 | 2.3 | 0.75 | 0.65 | 1.6 | 2.5 |
| A-2 With 6.2 % MPDA, 8.6 % CMPDA, and 3 % Urea in the pad bath | | | | | | |
| 2-2b | 0 | 2.7 | 0.99 | 0.86 | 1.8 | 2.1 |
| 4-2a | 0 | 2.3 | 0.89 | 0.78 | 1.5 | 1.9 |
| | 6 | 1.8 | 0.68 | 0.59 | 1.2 | 2.0 |
| | 10 | 2.3 | 0.76 | 0.66 | 1.6 | 2.4 |
| 4-2b | 0 | 2.2 | 0.86 | 0.75 | 1.4 | 1.9 |
| | 6 | 2.0 | 0.73 | 0.64 | 1.4 | 2.2 |
| | 10 | 2.1 | 0.74 | 0.65 | 1.4 | 2.2 |
| A-3 With 4.7 % MPDA, 6.4 % CMPDA, and 3% Urea in the pad bath. | | | | | | |
| 4-3a | 0 | 1.8 | 0.74 | 0.65 | 1.1 | 1.7 |
| | 6 | 1.4 | 0.57 | 0.50 | 0.9 | 1.8 |
| | 10 | 1.4 | 0.55 | 0.48 | 0.9 | 1.9 |
| 4-3b | 0 | 1.7 | 0.74 | 0.65 | 1.0 | 1.5 |
| | 10 | 1.6 | 0.69 | 0.60 | 1.0 | 1.7 |
| 4-3c | 0 | 1.6 | 0.68 | 0.59 | 1.0 | 1.7 |
| | 10 | 1.3 | 0.52 | 0.45 | 0.8 | 1.8 |
| 4-3d | 0 | 2.0 | 0.83 | 0.72 | 1.3 | 1.8 |
| | 10 | 1.7 | 0.65 | 0.57 | 1.1 | 1.9 |

[a]Calculated from % Cl, assuming no Cl loss from CMPDA moiety.

The above table shows the effect of laundering according to the DOC FF 3-71 test procedures on the P and Cl content of 8 samples of printcloth treated with an equimolar mixture of MPDA and CMPDA. After 10 launderings, the P content of some samples was the same as before laundering. Some other samples had a somewhat lower P content after 6 launderings, but this may be only a result of lack of uniformity of the small size samples submitted for analysis.

The Cl content changed in the similar manner as the P content and showed an average loss of 18 percent of the original chlorine after 10 washes. Assuming that all of the Cl on reacted CMPDA remained fixed, the analytical data confirm the conclusion that MPDA is more reactive than CMPDA in the application of the mixture by a factor of about 2 to 1.

EXAMPLE 4

Using 100% cotton print cloth and varying MPDA/CMPDA mol ratios the results in Table 5 were obtained. Wet pickup was 80% to 90%. Drying was conducted at 82° C., curing was conducted for 3 minutes at 175° C. The results indicate various mixtures gave more flame retardancy than either material alone -- at the same phosphorus levels applied. The results suggest that mixtures of MPDA and CMPDA slightly outside the range of the ratios tested would also have the synergistic effect.

Table 5

100% Cotton Print Cloth (Varying MPDA/CMPDA molratio)

| Sample | Solution: % | Mole | MPDA/-CMPDA Ratio Applied | % P Gain | %Wt. LOI[%$O_2$] |
|---|---|---|---|---|---|
| B/12-1/1 | 12.0/0 | 100/0 | 3.5 | 9.14 | 28.0 |
| 1/2 | 9.0/4.1 | 75/25 | 3.5 | 10.09 | 28.5 |
| 1/3 | 6.0/8.2 | 50/50 | 3.5 | 10.73 | 29.2 |
| 1/4 | 3.0/12.3 | 25/75 | 3.5 | 10.63 | 29.0 |
| 1/5 | 0/16.3 | 0/100 | 3.5 | 10.99 | 28.4 |
| B/12-1/6 | 17.2/0 | 100/0 | 5.0 | 13.0 | 31.8 |
| 1/7 | 12.9/5.8 | 75/25 | 5.0 | 13.73 | 32.4 |
| 1/8 | 8.6/11.7 | 50/50 | 5.0 | 13.20 | 32.5 |
| 1/9 | 4.3/17.5 | 25/75 | 5.0 | 14.40 | 32.7 |
| 1/10 | 0/23.3 | 0/100 | 5.0 | 14.55 | 31.9 |

I claim:

1. Synergistic mixtures of the reactive flame retardants methyl phosphonic diamide and chloromethyl phosphonic diamide.

2. A mixture of substantially equimolar portions of methyl phosphonic diamide and chloromethyl phosphonic diamide.

3. A process for rendering a cellulose-containing textile substrate flame retardant, said process comprising contacting a liquid comprising a mixture of claim 1 with said substrate, subsequently drying the treated substrate, and subsequently curing the dried substrate, thereby bonding flame retardant moieties to said substrate.

4. A process for rendering a cellulose-containing textile substrate flame retardant, said process comprising contacting a liquid comprising a mixture of claim 2 with said substrate, subsequently drying the treated substrate, and subsequently curing the dried substrate, thereby bonding flame retardant moieties to said substrate.

5. A flame resistant cellulose-containing textile product produced by the process of claim 3.

6. A flame resistant cellulose-containing textile products produced by the process of claim 4.

7. Substantially 100 percent cotton fabric rendered flame retardant with a synergistic mixture of methyl phosphonic diamide and chloromethyl phosphonic diamide.

8. A fire retardant fabric of claim 7 wherein said diamides are in substantally equimolar portions.

* * * * *